US006166492A

United States Patent [19]

Nuckolls

[11] Patent Number: 6,166,492

[45] **Date of Patent: *Dec. 26, 2000**

[54] LOW LOSS, ELECTRONIC BALLAST

[75] Inventor: Joe A. Nuckolls, Blacksburg, Va.

[73] Assignee: Hubbell Incorporated, Orange, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/145,731

[22] Filed: Nov. 4, 1993

Related U.S. Application Data

[63] Continuation of application No. 07/863,272, Apr. 3, 1992, abandoned.

[51] Int. Cl.[7] ..... H05B 37/02

[52] U.S. Cl. ..... 315/205; 315/289

[58] Field of Search ..... 315/205, 106, 315/289

[56] References Cited

U.S. PATENT DOCUMENTS

| | | | |
|---|---|---|---|
| 3,710,184 | 1/1973 | Williams | 315/227 |
| 3,771,014 | 11/1973 | Paget | 315/136 |
| 3,849,717 | 11/1974 | Walz et al. | 321/15 |
| 3,909,666 | 9/1975 | Tenen | 315/200 R |
| 3,925,705 | 12/1975 | Elms et al. | 315/246 |
| 3,944,876 | 3/1976 | Helmuth | 315/205 |
| 3,963,958 | 6/1976 | Nuckolls | 315/289 |
| 4,100,462 | 7/1978 | McLellan | 315/179 |
| 4,162,429 | 7/1979 | Elms et al. | 315/284 |
| 4,337,417 | 6/1982 | Johnson | 315/290 |
| 4,447,765 | 5/1984 | Cote | 315/240 |
| 4,513,227 | 4/1985 | Labadini et al. | 315/290 |
| 4,516,056 | 5/1985 | Cote | 315/240 |
| 4,525,651 | 6/1985 | Ahlgren | 315/240 |
| 4,866,347 | 9/1989 | Nuckolls et al. | 315/106 |
| 5,059,867 | 10/1991 | Nerone et al. | 315/290 |

FOREIGN PATENT DOCUMENTS

| | | |
|---|---|---|
| 0 041 027 A1 | 12/1981 | European Pat. Off. . |
| 0 254 326 | 7/1987 | European Pat. Off. . |
| 1270480 | 4/1972 | United Kingdom . |
| 2 018 062 | 10/1979 | United Kingdom . |
| 2 104 319 | 3/1983 | United Kingdom . |
| 2 165 407 | 4/1986 | United Kingdom . |
| WO 83/01555 | 4/1983 | WIPO . |

*Primary Examiner*—Michael Shingleton
*Attorney, Agent, or Firm*—Oblon, Spivak, McClelland, Maier & Neustadt, P.C.

[57] ABSTRACT

A low loss capacitive delivery system for converting a low voltage AC power source into a driving energy for a high voltage lamp is disclosed. The system involves delivering two energy loops with the first energy loop consisting of a high voltage low energy output to the lamp during a first half cycle of the AC power source operation and the second energy loop utilizing a high energy low voltage system delivering a high energy capacitive pulse to the lamp during a subsequent second half cycle operation of the power source. The first energy loop functions to lower the resistance of the lamp and the second energy loop operates the lamp after its resistance has been lowered. The system contains a matrix of diodes arranged in order to deliver the capacitive pulse of the second energy loop and to bypass the low energy high voltage circuit.

12 Claims, 4 Drawing Sheets

LOW LOSS, ELECTRONIC BALLAST

This application is a Continuation of application Ser. No. 07/863,272, filed on Apr. 3, 1992, now abandoned.

BACKGROUND OF THE INVENTION

1. Field of the Invention

The present invention relates to an electronic ballast for starting and operating high intensity discharge (HID) lamps using a new, low energy loss circuit arrangement connected across a common low voltage AC power source which provides improved efficiency when contrasted with conventional HID lamp ballasts.

2. Discussion of the Background

Prior art HID ballast circuit such as disclosed in U.S. Pat. No. 4,337,417 utilize transformers connected in series to an input AC voltage source at one end and to an output terminal of a HID lamp at the other end. Capacitors and charging resistors as well as blocking diodes are utilized in order to effect high voltage starting pulses for lamp ignition. Ignition occurs when a capacitor is initially charged to the peak voltage of the AC source during the negative half cycle of the source and then when the source voltage goes negative the voltage of the first capacitor is added to a second capacitor in order to provide a voltage of twice the AC input source voltage. A transformer utilizes discharge energy and applies a voltage pulse of sufficient magnitude across a lamp. This type of prior art suffers from a lack of efficiency because of energy loss in the circuit. Most energy loss occurs in the transformers which generate high heat losses. Thus there is critical need to more efficiently start and operate HID lamps without the high energy losses which are characteristic of the conventional ballast circuits using a high loss element.

Other prior art devices have attempted to address this high loss problem. One approach is the "lead ballast" circuit structure such as shown in U.S. Pat. No. 3,710,184 wherein a low energy circuit is used to cause an open circuit voltage (OCV) for lamp ignition to be increased. This type of system also has energy losses which cause it to provide less than an optimal solution.

Another approach is taken in the U.S. Pat. No. 3,700,962 of Munson which utilizes a low voltage high energy source but which does not provide any measure of taking into account the dynamic impedance of the discharge necessary with HID lamps. That is, many discharge lamps have dynamic specific needs which cannot be addressed by a single application of a voltage or a single application of one single specific amount of energy.

Thus there remains a need to more efficiently start and operate HID lamps without the high energy losses which are characteristic of conventional ballast circuits using a high loss element. There is also a simultaneous need to operate HID lamps using systems which are capable of taking into account the dynamic impedance requirements for HID lamps without a substantial loss of efficiency.

SUMMARY OF THE INVENTION

Accordingly, it is an object of the present invention to provide a low loss capacitive ballast circuit which overcomes the drawbacks associated with prior art devices.

It is a further object of the present invention to provide a low energy loss circuit which is capable of providing energy pulses of sufficient magnitude to efficiently start and operate the high intensity discharge (HID) lamps.

Still a further object is to provide a ballast circuit arrangement which uses a novel concept for processing electrical energy from an AC source by providing a driving voltage sufficient to cause the dynamic impedance of the lamps to be power pulsed by a capacitively dictated energy pulse by using a plurality of energy delivery loops to cause the lamp to receive energy in stages.

It is still a further object of the present invention to provide a novel circuitry which first provides a low energy sufficient to drive down the resistance of a HID lamp from a high driving voltage loop and subsequently delivers a larger energy pulse at a lower voltage to operate the HID lamp having the lowered resistance.

It is a further object to provide multiple voltage energy delivery loops each having different energy levels in order to properly meet the various dynamic needs of high energy discharge lamps.

BRIEF DESCRIPTION OF THE DRAWINGS

The foregoing features and objects of the present invention will become clearer upon the following detailed description of the preferred embodiments where like numerals represent like elements throughout the description.

DETAILED DESCRIPTION OF THE PREFERRED EMBODIMENTS

Figure 3:
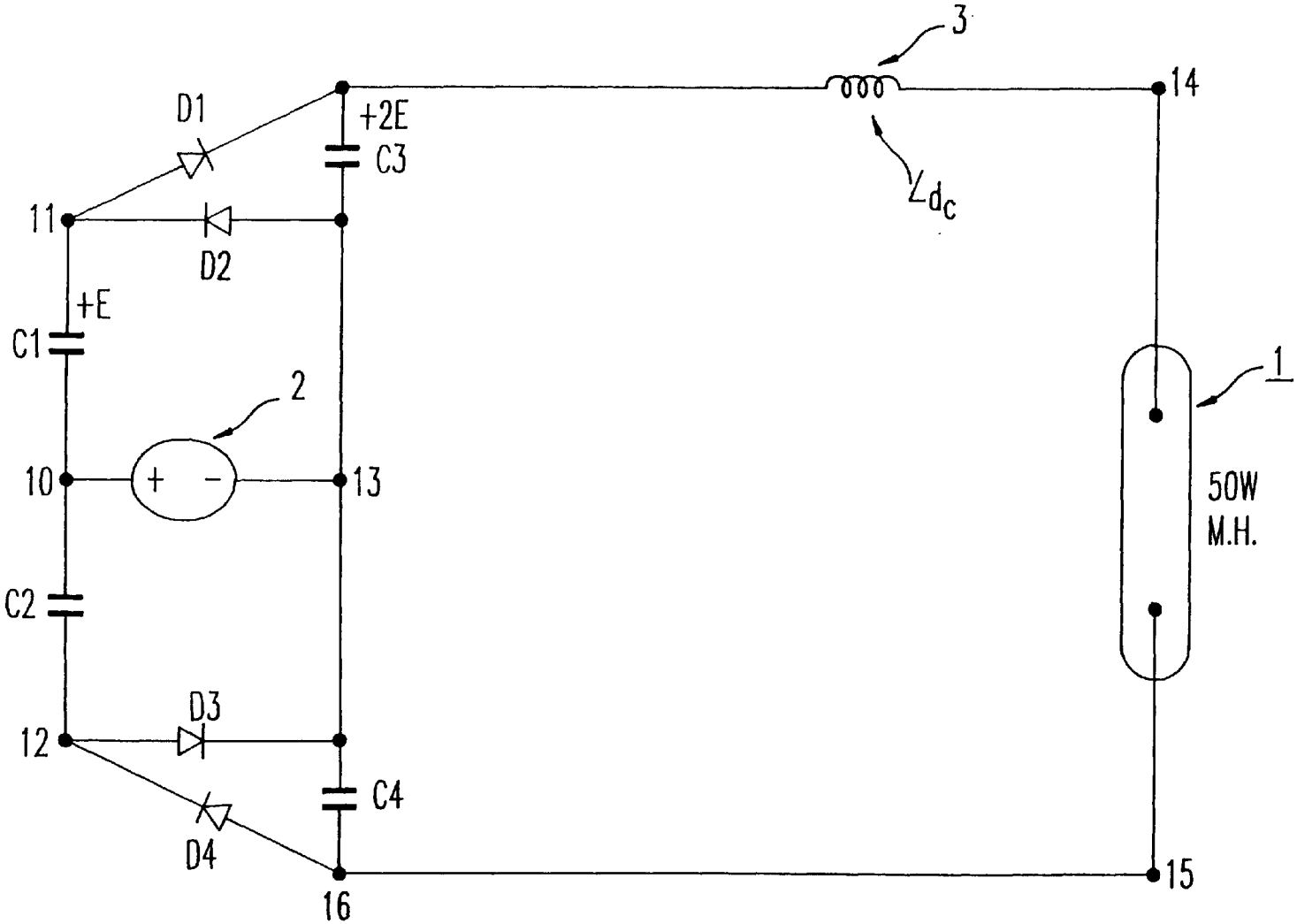
FIG. 3 shows a detailed arrangement of the capacitive circuit connected between an AC voltage and the HID lamp according to the present invention.

Referring now to FIG. 3 of the drawings, the ballast circuit structure of the invention uses a low voltage AC input source 2, connected between two symmetrical circuits. The first circuit includes the capacitor $C_1$ and $C_3$ with the diode matrix D1 and D2 being connected across the capacitor $C_3$ and to one terminal of the capacitor $C_1$. Capacitor $C_1$ has the other terminal connected to one input of the source 2 and the other input of the source is connected to the junction between the capacitor $C_3$ and the diode D2. The other half of the symmetrical circuitry formed by capacitor $C_2$ and $C_4$ and diode D3 and D4 are connected in the same manner. Terminals 15 and 16 designate the outputs of the symmetrical circuit with terminal 15 being connected at the juncture between capacitor $C_3$ and diode Dl and the terminal 16 being taken at the juncture between the capacitor $C_4$ and the diode D4. The voltage formed at terminals 15 and 16 constitutes the open-circuit voltage (OCV) provided through an inductive reactor 3 which bridges the input terminal 14 of the metal halide HID lamp 1.

The ballast circuit of FIG. 3 is such that when a voltage is applied from the source 2, the capacitor $C_1$ and $C_2$ are charged to a value equal to the peak voltage of the AC source which is 170 volts (designated as E in FIG. 3) in the case of a 120 volt AC source and the capacitors $C_3$ and $C_4$ are charged to a value which is twice the peak value or 340 volts (designated as 2E in FIG. 3). For purposes of the operation of a HID lamp, the capacitors $C_1$ and $C_2$ are sized to be high energy capacitors while the capacitors $C_3$ and $C_4$ are sized to be low energy capacitors. Thus, the capacitor $C_3$ and $C_4$ are high voltage low energy capacitors while the capacitors $C_1$ and $C_2$ are low voltage high energy capacitors. The lamp driving energy which is necessary for ordinary operation of the lamp is effectively placed on the high energy capacitor element $C_1$ which dictates the amount by the sizing of the capacitor. This energy is trapped until a next half cycle of the AC source when, through the action of the diode matrix D1, D2, this energy is passed on to the lamp. However, the passing on to the lamp during a subsequent half cycle is not accomplished until the lamp 1 has its impedance lowered by the output from the high voltage low energy source $C_3$. After the low energy high voltage source $C_3$ pushes the lamp to its lower impedance instantaneous state, it is able to receive the energy from the high energy source $C_1$ in order to operate the lamp. Thus, there is a two-stage delivery system to the structure of FIG. 3. In a first stage the higher voltage low energy source on the capacitor $C_3$ pushes the lamp into a lower impedance instantaneous state which enables the lower voltage high energy source $C_1$ to subsequently deliver its energy to the discharge lamp impedance level in a second stage.

It is the diode matrixing shown in FIG. 3 which allows the low voltage high energy pulse from $C_1$ to bypass the higher voltage lower energy source $C_3$ as it delivers its high energy pulse to the lamp load. The distribution of the various energy magnitudes required for the first and second loops is easily ratioed to meet the specific discharge lamp dynamic needs. The symmetry set up by the $C_1$, $C_3$ and D1 and D2 operation is of course mirrored in the $C_2$, $C_4$ and D3, D4 circuit.

In the embodiment of FIG. 3, the source 2 is a 120 volt AC source and the capacitors $C_1$ and $C_2$ are 22.5 microfarad while the capacitors $C_3$ and $C_4$ are 4 microfarad. The lamp being served is a 50 watt M.H. (Metal Halide). The shown inductor Ldc is 28 watt in the example of FIG. 3. Of course, the reactor Ldc could be replaced with other structures such as resistors or chokes or incandescent lamps. Furthermore, the use of a SIDAC is anticipated as an alternate embodiment. The important feature however is that the circuitry of FIG. 3 generates a OCV voltage of 4×170=680 volts and the arrangement of the capacitors and diodes provides for the two-stage operation wherein the high voltage low energy capacitors $C_3$ and $C_4$ pushes the lamp into a lower impedance instantaneous state which therefore enables the low voltage high energy source $C_1$ and $C_2$ to deliver its energy to the discharge lamp impedance level. This is made possible because of the diode matrixing D1–D2 and D3–D4.

Figure 4:
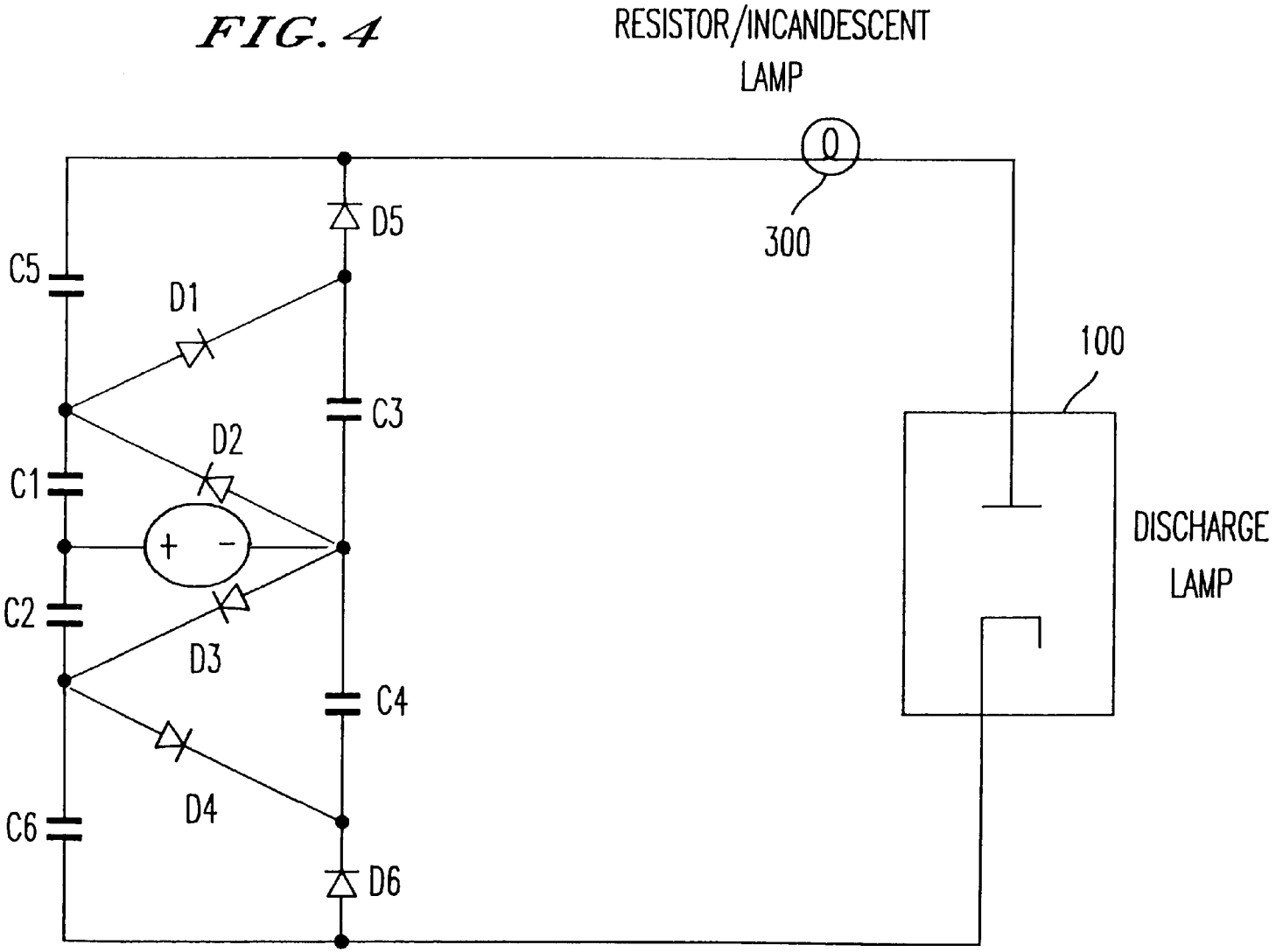
FIG. 4 shows an alternate embodiment of the circuit arrangement utilizing additional higher voltage low energy source superimposed to ignite a high discharge lamp involving additional charging energy loops connected in parallel with the AC source input.

The FIG. 4 shows an alternate embodiment using the superposition of an even higher voltage very low energy source $C_5$, $C_6$ which may be used to ignite the lamp. As many voltage energy level sources as necessary can be easily added in order to obtain the full dynamic impedance behavior demanded by the particular lamp 1. In many instances, the low energy circuit symmetry on either side of the AC source may not be necessary for lamp ignition.

It is to be noted that the open circuit voltage (OCV) of volts the embodiment of FIG. 3 is equal to four times 170 or 680 while the open circuit voltage (OCV) of the variation of FIG. 4 provides an open circuit voltage of six times 170 or 1,020 volts.

Figure 2:
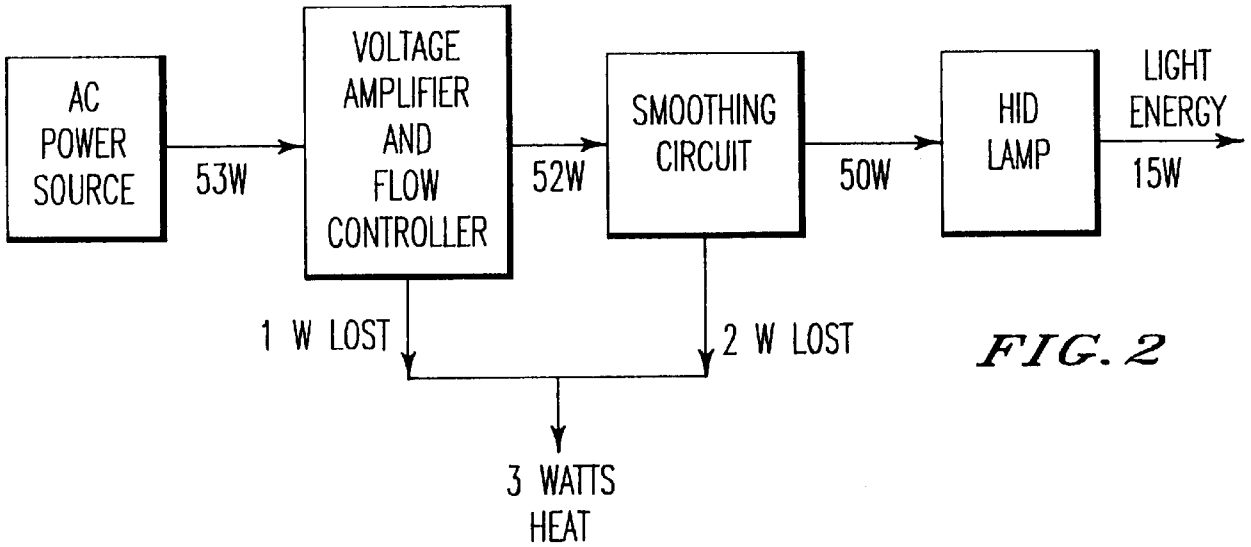
FIG. 2 shows the energy flow in a low-loss capacitive ballast circuit used in the system of the present invention.

The FIG. 4 embodiment for a particular discharge lamp 100 shows the utilization of a resistor or incandescent lamp 300 which may also be a choke or other structure appropriate to required operation of the lamp. The capacitor $C_5$ and the capacitor $C_6$ have a value of 0.1 microfarad when a 100 watt, 144 ohm resistor or incandescent lamp 300 is utilized in conjunction with the discharge lamp 100. Thus, it can be seen that the energy level is much lower than that of the FIG. 3 embodiment. Consequently, the capacitors $C_5$ and $C_6$ in the FIG. 2 provide a superposition of an even higher voltage and very low energy source to ignite the lamp. Once again, the distribution of the various energy magnitudes can be easily adjusted to meet the specific discharge lamp dynamic needs. It must also be emphasized that as many voltage-energy level sources as necessary can be added to the FIG. 4 embodiment as is necessary to meet the full dynamic impedance behavior of a particular lamp. It is also noted that the low energy circuit symmetry on either side of the AC source 2 is not necessary for lamp ignition in many lamp instances.

The superimposing of different energy levels from several sources, each delivering their designed quantity of energy via the diode matrix without losses or interference, provides the low loss flexible improved ballast circuit for the ignition and the economic and efficient sustaining of HID lamps.

Figure 1:
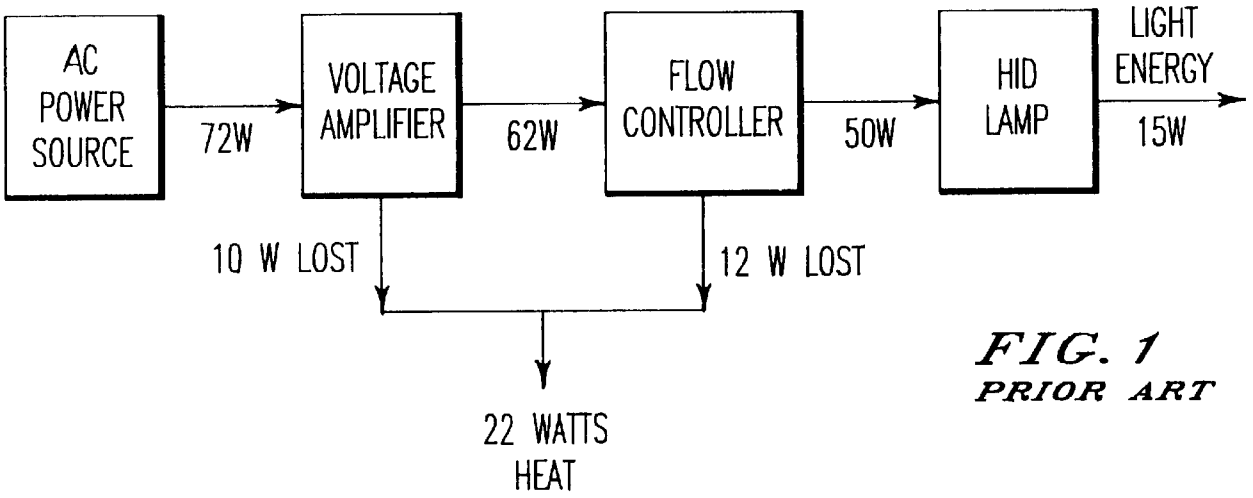
FIG. 1 PRIOR ART
FIG. 1 is an illustration of the energy flow in a prior art ballast circuit arrangement.

A comparison of the FIGS. 1 and 2 shows the improved efficiency resulting from the system of FIG. 3. In the prior art which utilized a combination of a voltage amplifier and a flow controller separately, there was a loss of 22 watts of heat and a requirement beginning with a power source providing 72 watts in order to provide the necessary 50 watt input for the HID lamp. In contrast, the FIG. 2 shows a three watt heat loss when the system of FIG. 3 is utilized. Thus, there is only a requirement for a source of power of 53 watts in order to deliver the necessary 50 watts to the HID lamp.

Figure 5:
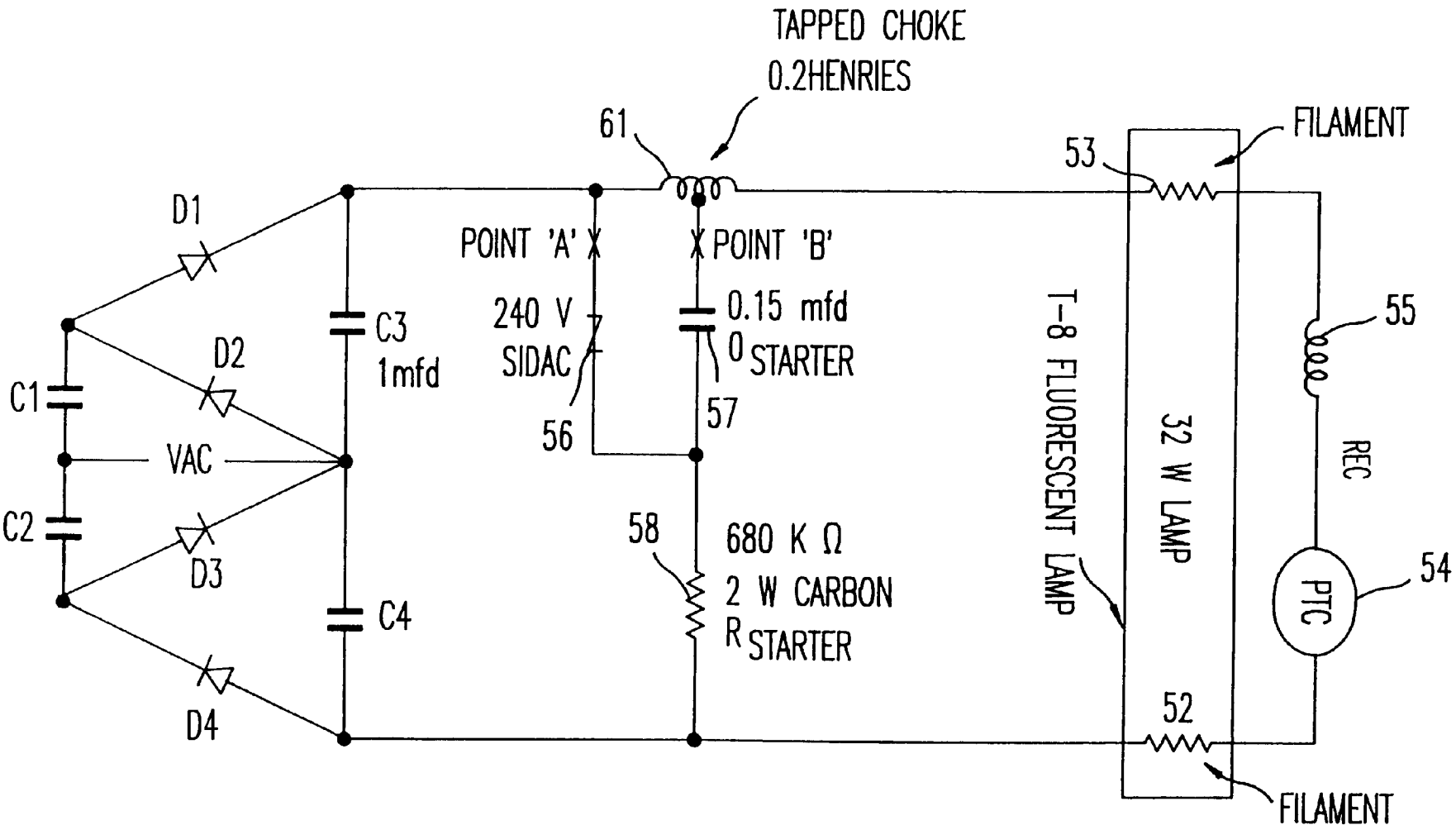
FIG. 5 illustrates a lamp circuit utilizing the capacitive circuit of the present invention modified for a T-8 fluorescent lamp.

The circuit shown in FIG. 5 embodies the capacitive circuit of FIG. 3 modified for a particular T-8 fluorescent lamp circuit. The fluorescent lamp circuit includes the filaments 51 and 52 and the preheating circuit constituted by the PTC (positive temperature coefficient resistance) and the RFC (radio frequency choke) 54 and 55, respectively. The remainder of the lamp circuit includes a SIDAC 56 and a starter capacitor 57 which in the particular example as a value of 0.15 micro farads. The capacitor 57 is connected in parallel with the SIDAC 56 which are in turn connected in series with the starter resistor 58 having a value of 680K ohms and being rated at 2 watts. The source used in the particular example is a 120 volt source VAC but it could be a higher voltage such as 277 if the supply-lamp system requires such a high voltage. The T-8 fluorescent lamp is a 32 watt lamp and with such a structure as shown in the FIG. 5 the tapped choke 61 has a value of 0.2 henries and the capacitors C1 and C2 have a value of 15 microfarads while the capacitors C3 and C4 have a value of 1 microfarad.

These values for the capacitors C1, C2 and C3, C4 would be only slightly larger in order to drive a 40 watt lamp. The losses from such a circuit as shown in FIG. 5 run between 1 and 2 watts and generate 3050 lumens or 90 system lumens-per-watt as compared to 53.5 L.P.W. for a standard F40CW T-12 single lamp ballast system and value of 63.5 lumens-per-watt for a two lamp ballast system of the prior art.

The two component (low cost, small lamp preheating circuit) (PTC and RFC) is used to provide a long lamp life, high lumen maintenance, and −20° F. starting which allows for outdoor applications. A cold PTC (positive temperature coefficient resistance) allows the proper preheating to take place and then effectively drops out of the circuit as the PTC resistance reaches high values. Subsequently, the low cost three component ignitor (56, 57 and 58) steps in to ignite the lamp and is then clamped off (de-energized) as the lamp comes on.

This system for the T-8 fluorescent lamp provides a tremendous improvement in performance efficiency especially in high volume building lighting.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electronic ballast circuit including a starting circuit and an operator circuit for starting and operating a high intensity discharge lamp from a low voltage AC power source, said operating circuit comprising:

first circuit means for storing a first voltage at a first energy level wherein said first circuit means provides an output to a high intensity discharge lamp and wherein said first voltage at said first energy level functions to lower an impedance of said lamp;

second circuit means including a second means for storing a second voltage at second energy level and providing an output pulse at said second energy level to said lamp in order to operate said lamp; and diode matrixing means connected between said first and second circuit means for causing said second energy level pulse to bypass said first circuit means during a half-cycle operation of said source and immediately following the lowering of said lamp impedance during said half-cycle, wherein said first circuit means for storing said first voltage and said second circuit means for storing said second voltage are selected so that a value of said first energy level is of the same order of magnitude as a value of said second energy level.

2. The circuit according to claim 1 further including a third circuit means and a second diode matrixing means for establishing a third voltage at a third energy level and outputting said third voltage at said energy level to said lamp.

3. An electronic valve circuit for a high intensity discharge lamp wherein said circuit is driven by a low voltage AC source and wherein said valve circuit includes a starter circuit and an operating circuit and wherein said operating circuit comprises:

a low energy, high voltage means for providing a first low energy delivery loop for lowering an impedance of said lamp, wherein said low energy high voltage means is connected to said source and provides said first energy delivery loop during a first half-cycle operation of said source; and a high energy, low voltage means for providing a second high energy delivery loop to said lamp subsequent to said first energy loop and subsequent to said impedance lowering of said lamp and which said high energy pulse operates said lamp, wherein said high energy loop has an energy value of the same order of magnitude as , but greater than, an energy value of said low energy loop and wherein said low energy loop and said high energy loop are both provided subsequent to ignition by said starter circuit of said lamp.

4. A low loss low voltage metal halide lamp ballast circuit, comprising:

a pulsed starter circuit for igniting said lamp;

a low voltage AC power source;

a low loss capacitive means connected to said power source for increasing the voltage output of said power source and controlling flow of at least two different levels of energy subsequent to said igniting of said lamp by said by said starting circuit to provide operation of said lamp wherein said at least two levels of energy are provided as a function of the dynamic impedance of said lamp and wherein a value of each of said at least two levels of energy is of the same order to magnitude as a value of another one of said two levels of energy.

5. The circuit according to claim 4 wherein said low loss capacitive means includes a low energy, high voltage capacitive delivery system for reducing the impedance of said lamp after ignition of said lamp and a high energy low voltage delivery system for delivering a high energy capacitive pulse to said reduced impedance in order to operate said lamp after ignition.

6. The circuit according to claim 5 wherein said low energy high voltage capacitive delivery system includes a first capacitor and wherein said high energy low voltage delivery system includes a second capacitor and a diode matrix arrangement the bypass of low energy high voltage capacitor during delivery of said capacitive result to said lowered resistance lamp.

7. An electronic ballast circuit for operating a high intensity discharge lamp from a low voltage AC power source, said circuit comprising:

first circuit means including a first capacitor for storing a first voltage at a first energy level wherein said first circuit means provides an output to said high intensity discharge lamp and wherein said first voltage at said first energy level functions to lower an impedance of said lamp;

second circuit means including a second capacitor for storing a second voltage at a second energy level and providing an output pulse at said second energy level to said lamp in order to operate said lamp; and diode matrixing means connected between said first and second circuit means for causing said second energy level pulse to bypass said first circuit means during a half-cycle operation of asid source and immediately following the lowering of said lamp impedance during said half-cycle, wherein a value of said first capacitor is the same order of magnitude as a value of said second capacitor.

8. The circuit according to claim 1 wherein said first circuit means comprises a first capacitor and said second circuit means comprises a second capacitor each of said first and second capacitors having a terminal connected to a respective output of said source and wherein said diode matrixing means includes a first and second diode with said first diode being connected to a second output of said source and to a second terminal of said first capacitor and wherein said second diode is connected to a second terminal of said first capacitor and to a second terminal of said second capacitor.

9. The circuit according to claim 3 wherein said low voltage high energy means includes a capacitor and a matrix connection of diodes wherein said matrix connection of diodes causes said low voltage high energy pulse to bypass said high voltage low energy means as said low voltage high energy means delivers said high energy pulse to said lamp.

10. The circuit according to claim 1 wherein said ballast circuit has an open circuit voltage of four times the peak value of said low voltage AC power source.

11. The circuit according to claim 3, wherein said ballast circuit has an open circuit voltage of four times the peak value of said low voltage AC power source.

12. The lamp ballast circuit according to claim 4, wherein said circuit has an open circuit voltage of four times the peak value of said low voltage AC power source.

* * * * *